United States Patent [19]

Husson

[11] 4,270,460

[45] Jun. 2, 1981

[54] LINKAGE DEVICE FOR DRAFTING TABLES

[76] Inventor: Richard R. Husson, 310 Riverside Dr., Room #1904, New York, N.Y. 10025

[21] Appl. No.: 1,682

[22] Filed: Jan. 8, 1979

[51] Int. Cl.[3] ..... A47F 5/12

[52] U.S. Cl. ..... 108/3; 248/284

[58] Field of Search ..... 108/3, 7, 1, 6; 248/284; 297/433, 436

[56] References Cited

U.S. PATENT DOCUMENTS

| | | | |
|---|---|---|---|
| 611,446 | 9/1898 | Cotner | 108/3 |
| 689,707 | 12/1901 | Davis | 108/3 |
| 976,639 | 11/1910 | Cots | 108/3 |
| 2,223,405 | 12/1940 | Cain | 108/3 |
| 2,501,415 | 3/1950 | Shampaine | 108/3 |

*Primary Examiner*—Roy D. Frazier
*Assistant Examiner*—Peter A. Aschenbrenner
*Attorney, Agent, or Firm*—Cooper, Dunham, Clark, Griffin & Moran

[57] ABSTRACT

The present invention concerns improved drafting tables provided with a drawing board, a shelf and a linkage device which enables the shelf to be maintained in a substantially horizontal position while the drawing board is moved between substantially horizontal and substantially vertical positions. Drafting tables which have been provided with a linkage device and shelf in accordance with this invention provide increased efficiency, comfort and convenience for persons using the tables.

13 Claims, 3 Drawing Figures

LINKAGE DEVICE FOR DRAFTING TABLES

U.S. Pat. Nos. 3,875,872 and 4,074,774 discloses work tables which are provided with a central working surface capable of tilting movement between horizontal and vertical positions. The tables described therein also include planar horizontal surfaces upon which writing instruments and various accessories such as lamps, telephones, ink bottles and the like may be placed. The work tables described in both of these patents are of a substantially different configuration than conventional drafting tables. U.S. Pat. No. 3,643,605 discloses a work table which is provided with a longitudinally and pivotally adjustable tray mounted on a drafting board and useful for holding writing instruments and other materials used by draftsmen, artists and the like.

All of the patents referred to hereinabove involve horizontal storage surfaces which are achieved and maintained by deliberate presetting of hardware adjustments and/or manually adjustable mechanisms. None of these tables involve a horizontal surface or shelf which moves cooperatively with the tilting movement of the drafting board while maintaining a substantially horizontal position. As a result, none of these tables provide a useful horizontal storage surface which is readily accessible to the user of the table throughout a wide range of variations in the position of the tiltable drawing board surface.

There has been a need for an improved drafting table which includes a horizontal storage surface or shelf useful for drawing instruments and other materials and which will provide the draftsman, artist or other user of the table with a maximum of convenience and efficiency. It is therefore the object of this invention to provide an improved and novel drafting table having a shelf which is continuously maintained in a horizontal position as the drawing surface is tilted between substantially horizontal and vertical positions.

In accordance with the present invention, this object is accomplished by a drafting table which comprises a base, a drafting board which is pivotally mounted to the base in order to permit tilting movement of the drafting board, a shelf, and means for maintaining the shelf in a substantially horizontal plane as the drafting board is moved between substantially horizontal and substantially vertical positions. Specifically, the means for so maintaining the shelf in a horizontal plane is a parallelogram linkage which is pivotally attached to the base, drafting board and shelf.

In order to permit a better understanding of the present invention a detailed description thereof will now be set forth with reference to the accompanying drawings.

DETAILED DESCRIPTION OF THE INVENTION

Figure 1:
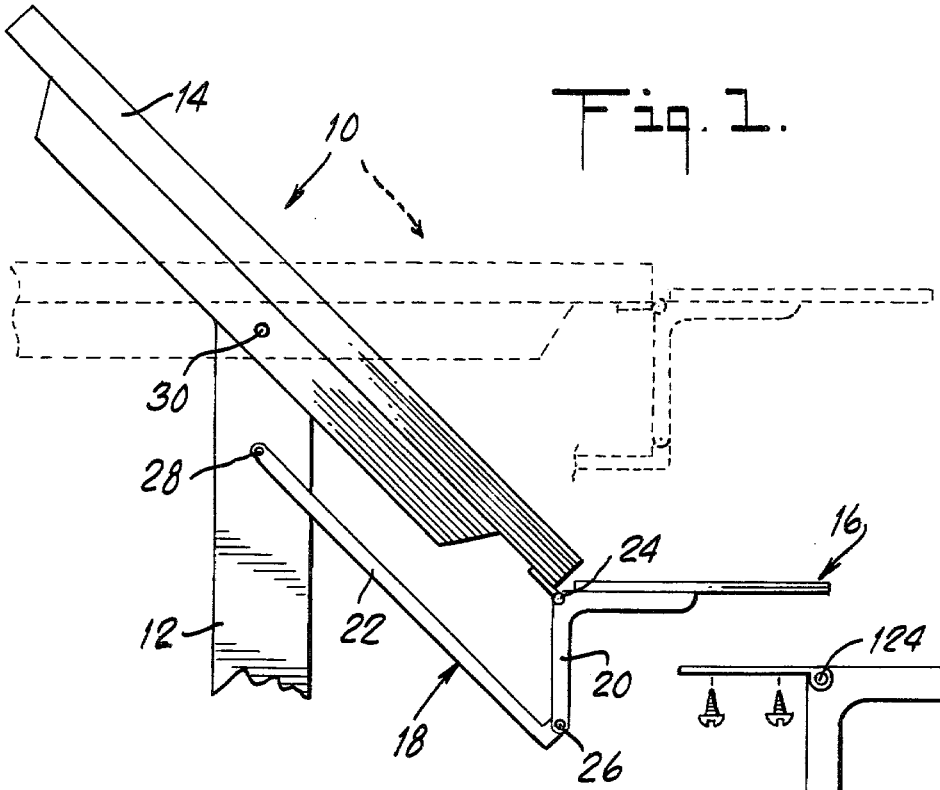
FIG. 1 shows a side elevation view of a drafting table in accordance with the present invention having the drafting board in a steeply inclined position. The dotted lines depict the table with the drafting board in a substantially horizontal position.

Specifically, in FIG. 1, there is illustrated a drafting table 10 in accordance with the present invention. Such a table may be used by a draftsman, artist or other person needing a working surface capable of tilting movement between substantially horizontal and substantially vertical positions. Drafting table 10 includes base 12 on which drafting board 14 is pivotally mounted. Drafting table 10 is also provided with storage surface or shelf 16. In FIG. 1 storage surface or shelf 16 is shown at the lower edge of drafting board 14. However, storage surface or shelf 16 could as readily be attached to the upper edge of the drafting board, or could be attached to a side edge of the drafting board. Alternatively, the drafting table could be provided with more than one storage surface or shelf such as is shown for example in FIG. 3.

Storage surface or shelf 16 may be used for storage of writing instruments, ink, erasers and the like and/or other accessories such as trays, lamps, telephones and the like which may be placed upon and/or attached to storage surface or shelf 16. As indicated hereinabove, the storage surface or shelf may be maintained in a substantially horizontal position during tilting movement of the drafting board between substantially horizontal and vertical positions by a suitable means such as parallelogram linkage 18.

Parallelogram linkage 18 consists of L-shaped bracket 20 and straight bracket 22. Storage surface or shelf 16 is attached to the substantially horizontal leg of L-shaped bracket 20 which is hingedly attached to the drafting board at the apex 24 of L-shaped bracket 20. Straight bracket 22 is pivotally attached at point 26 to the substantially vertical leg of L-shaped bracket 20 and is pivotally attached at point 28 to base 12. The distance from the point of attachment 28 to the point 30 where the drafting is pivotally mounted on the base is the same as the distance between apex 24 and attachment point 26 along the vertical leg of L-shaped bracket 20. Thus by means of such brackets pivotally attached in the manner and at the locations described, a parallelogram linkage is formed which enables storage surface or shelf 16 to be maintained in a substantially horizontal position while drafting board 14 is moved from substantially horizontal to substantially vertical positions.

Figure 2:
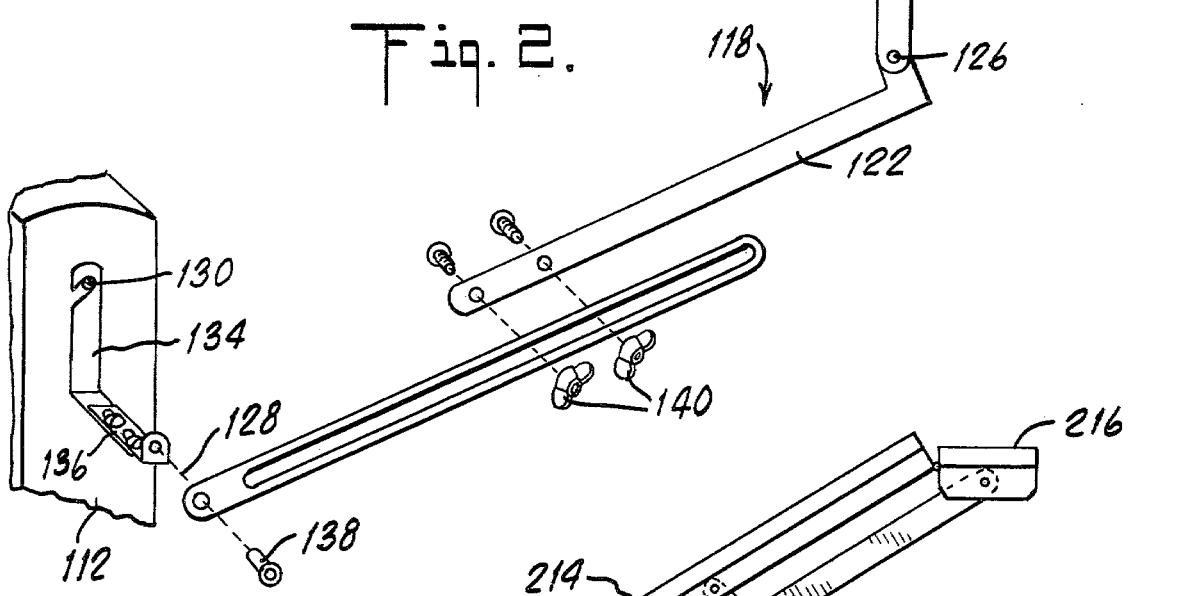
FIG. 2 is an exploded perspective drawing of an alternative embodiment of the parallelogram linkage shown in FIG. 1.

Turning now to FIG. 2, there is shown an alternative embodiment of a linkage device in accordance with the present invention. The linkage device there shown in suitable for attachment to most conventional drafting tables permitting such tables to be readily converted so as to take full advantage of the teachings of the present invention. Specifically, the linkage device 118 which is shown includes L-shaped bracket 120 which can be hingedly attached to the drafting board at the bracket's apex 124. Straight bracket 122 is pivotally attached to the substantially vertical leg of L-shaped bracket 120 at point 126. The length of straight bracket 122 may desirably be slidably adjustable by a suitable means such as wing nuts 140. In this way the linkage device can be fitted to nearly all drafting tables of conventional design and the necessity of manufacturing linkage devices of various sizes can be obviated.

Linkage device 118 of FIG. 2 also includes U-shaped bracket 134 having a shorter arm which is pivotally attached to straight bracket 122 at point 128, e.g. by means of rivet 138, and having a longer arm which can be fixedly attached to the base of the drafting table at point 130. Point of attachment 130 is also the point at which the drafting board is pivotally mounted on the base of the table. Additionally, U-shaped bracket 134 is provided with screws 136 so that the width of the U-shaped bracket is slidably adjustable. By means of such slidable adjustment of the U-shaped bracket drafting tables can be provided with a storage surface or shelf having considerable stability regardless of the width of the table. The distance along the longer arm of U-shaped bracket 134 from attachment point 130 to the horizontal plane through point 128 is equal to the distance between apex 124 and attachment point 126 along the vertical leg of the L-shaped bracket 120 so that upon attachment of linkage device 118 a parallelogram linkage is formed which permits a storage shelf or surface to be maintained in a substantially horizontal plane as the drawing board surface is subjected to tilting movement between substantially horizontal and substantially vertical positions.

Figure 3:
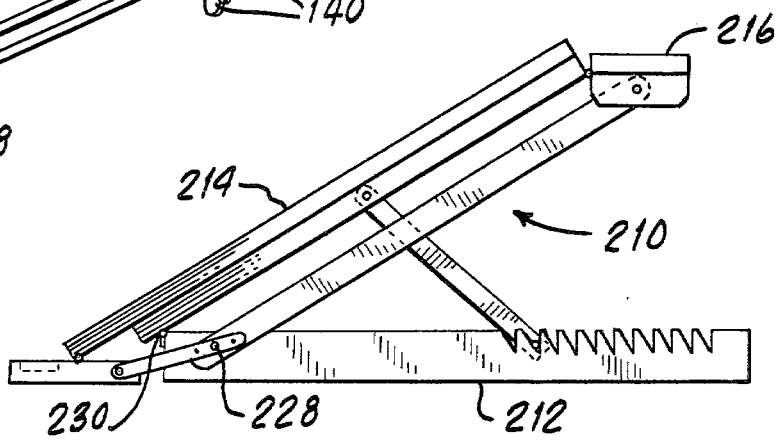
FIG. 3 is a side elevation view of another embodiment of a drafting table in accordance with this invention which has been provided with horizontal storage shelves at both the upper and lower edges of the drafting board.

FIG. 3 illustrates an alternative embodiment of a drafting table in accordance with the present invention. The drafting table depicted is provided with two storage surfaces or shelves. One is positioned at the top and one at the bottom edge of the drafting table. By means of two parallelogram linkages having in common attachment points 228 and 230 both of these storage surfaces or shelves may be maintained in substantially horizontal positions as the drafting board is subjected to various tilting movements.

In all of the foregoing no discussion has been had of the various materials out of which the drafting table and/or linkage device might appropriately be constructed since it is well-known to persons in the art that countless materials including but not limited to various woods, metals, plastics and the like are suitable for fabrication of the various parts of a drafting table such as is described hereinabove.

Furthermore, as will be obvious to one skilled in the art, many modifications, variations and alterations can be made in the practices of the present invention without departing from the spirit and scope thereof as set forth in the preceding description or in the claims which follow:

I claim:

1. A drafting table which comprises:

a base;

a drafting board pivotally mounted on said base to permit tilting movement of said drafting board between substantially horizontal and substantially vertical positions;

a shelf adapted for attachment to said drafting board;

an L-shaped bracket hingedly attached at the apex of said L-shaped bracket to said drawing board, one leg of said L-shaped bracket being substantially horizontal and having said shelf attached thereto and the other leg of said L-shaped bracket being substantially vertical;

a straight bracket one end of which is pivotally attached to the end of said substantially vertical leg of said L-shaped bracket; and a U-shaped bracket having arms of unequal length, the shorter arm being pivotally attached to the opposite end of said straight bracket from the end of said straight bracket pivotally attached to said L-shaped bracket, and the longer arm being fixedly attached to said base at the point where said drafting board is pivotally mounted on said base.

2. A drafting table in accordance with claim 1 wherein the length of said straight bracket is slidably adjustable.

3. A drafting table in accordance with claim 1 wherein the width of said U-shaped bracket is slidably adjustable.

4. A linkage device for attaching a shelf to a drafting table, said drafting table having a base and a drafting board pivotally mounted on said base to permit tilting movement of said drafting board between substantially horizontal and substantially vertical positions, which comprises:

an L-shaped bracket hingedly attached at the apex of said L-shaped bracket to said drawing board, one leg of said L-shaped bracket being substantially horizontal and having said shelf attached thereto, and the other leg of said L-shaped bracket being substantially vertical; and a straight bracket, one end of which is pivotally attached to the end of said substantially vertical leg of said L-shaped bracket, and the other end of which is pivotally attached to said base at a point the distance from which to the point where said drafting board is pivotally mounted on said base is the same as the distance between said apex and the point where said straight bracket is pivotally attached to said vertical leg of said L-shaped bracket.

5. A linkage device in accordance with claim 4 wherein the length of said straight bracket is slidably adjustable.

6. A linkage device for attaching a shelf to a drafting table, said drafting table having a base and a drafting board pivotally mounted on said base to permit tilting movement of said drafting board between substantially horizontal and substantially vertical positions, which comprises:

an L-shaped bracket hingedly attached at the apex of said L-shaped bracket to said drawing board, one leg of said L-shaped bracket being substantially horizontal and having said shelf attached thereto and the other leg of said L-shaped bracket being substantially vertical;

a straight bracket, one end of which is pivotally attached to the end of said substantially vertical leg of said L-shaped bracket; and a U-shaped bracket having arms of unequal length, the shorter arm being pivotally attached to the opposite end of said straight bracket from the end of said straight bracket pivotally attached to said L-shaped bracket and the longer arm being fixedly attached to said base at the point where said drafting board is pivotally mounted on said base.

7. A linkage device in accordance with claim 6 wherein the length of said straight bracket is slidably adjustable.

8. A linkage device in accordance with claim 7 wherein the width of said U-shaped bracket is slidably adjustable.

9. A drafting table which comprises:

a base;

a drafting board pivotally mounted on said base to permit tilting movement of said drafting board between substantially horizontal and substantially vertical positions;

a shelf adapted for attachment to said drafting board; and means for maintaining said shelf in a substantially horizontal plane as said drafting board is moved between said positions, said means being a parallelogram linkage formed by an L-shaped bracket hingedly attached at the apex of said L-shaped bracket to said drawing board, one leg of said L-shaped bracket being substantially horizontal and having said shelf attached thereto, and the other leg of said L-shaped bracket being substantially vertical; and a straight bracket, one end of which is pivotally attached to the end of said substantially vertical leg of said L-shaped bracket, and the other end of which is pivotally attached to said base at a point the distance from which to the point where said drafting board is pivotally mounted on said base is the same as the distance between the apex and the point where said straight bracket is pivotally attached to said vertical leg of said L-shaped bracket.

10. A drafting table in accordance with claim 9 wherein the length of said straight bracket is slidably adjustable.

11. A drafting table which comprises:

a base;

a drafting board pivotally mounted on said base to permit tilting movement of said drafting board between substantially horizontal and substantially vertical positions;

a shelf adapted for attachment to said drafting board; and means for maintaining said shelf in a substantially horizontal plane as said drafting board is moved between said positions, said means being a parallelogram linkage formed by an L-shaped bracket hingedly attached at the apex of said L-shaped bracket to said drawing board, one leg of said L-shaped bracket being substantially horizontal and having said shelf attached thereto, and the other leg of said L-shaped bracket being substantially vertical; a straight bracket, one end of which is pivotally attached to the end of said substantially vertical leg of said L-shaped bracket; and a U-shaped bracket having arms of unequal length, the shorter arm being pivotally attached to the opposite end of said straight bracket from the end of said straight bracket pivotally attached to said L-shaped bracket and the longer arm being fixedly attached to said base at a point where said drafting board is pivotally mounted on said base.

12. A drafting table in accordance with claim 11 wherein the length of said straight bracket is slidably adjustable.

13. A drafting table in accordance with claim 11 wherein the width of said U-shaped bracket is slidably adjustable.

* * * * *